US012612702B2

(12) United States Patent
Weinelt et al.

(10) Patent No.: US 12,612,702 B2
(45) **Date of Patent: *Apr. 28, 2026**

(54) ELECTROCHEMICAL OXIDATION OF CYCLOALKENES TO FORM ALPHA, OMEGA-DICARBOXYLIC ACIDS AND KETOCARBOXYLIC ACIDS

(71) Applicant: Evonik Operations GmbH, Essen (DE)

(72) Inventors: Frank Weinelt, Billerbeck (DE); Franz-Erich Baumann, Duelmen (DE); Siegfried R. Waldvogel, Gau-Algesheim (DE); Silja Hofmann, Wiesbaden (DE); Joachim Nikl, Frankfurt am Main (DE)

(73) Assignee: Evonik Operations GmbH, Essen (DE)

( * ) Notice: Subject to any disclaimer, the term of this patent is extended or adjusted under 35 U.S.C. 154(b) by 0 days.

This patent is subject to a terminal disclaimer.

(21) Appl. No.: 18/851,145

(22) PCT Filed: Mar. 22, 2023

(86) PCT No.: PCT/EP2023/057341
§ 371 (c)(1),
(2) Date: Sep. 26, 2024

(87) PCT Pub. No.: WO2023/186658
PCT Pub. Date: Oct. 5, 2023

(65) Prior Publication Data

US 2025/0215584 A1 Jul. 3, 2025

(30) Foreign Application Priority Data

Mar. 28, 2022 (EP) ..... 22164784

(51) Int. Cl.
*C25B 3/07* (2021.01)
*C25B 3/23* (2021.01)
*C25B 9/15* (2021.01)
*C25B 9/17* (2021.01)

(52) U.S. Cl.
CPC ..... *C25B 3/07* (2021.01); *C25B 3/23* (2021.01); *C25B 9/15* (2021.01); *C25B 9/17* (2021.01)

(58) Field of Classification Search
None
See application file for complete search history.

(56) References Cited

U.S. PATENT DOCUMENTS 5,026,461 A 6/1991 Davis et al.
5,236,561 A * 8/1993 Wilhoit ..... C07C 51/313 205/440
11,976,373 B2 5/2024 Weinelt et al.
2022/0227932 A1 7/2022 Weinelt et al.
2023/0212762 A1 7/2023 Weinelt et al.
2023/0235464 A1* 7/2023 Neumann ..... C25B 11/077 205/455
2025/0109509 A1 4/2025 Weinelt et al.
2025/0215583 A1 7/2025 Baumann et al.
2025/0223709 A1 7/2025 Weinelt et al.

FOREIGN PATENT DOCUMENTS

CN 101092705 12/2007
CN 104032327 6/2016
DE 40 29 068 3/1992
JP 2019-99861 6/2019
WO 2021/260679 12/2021

OTHER PUBLICATIONS

Bäumer et al., "Cleavage of alkenes by anodic oxidation", Journal of Applied Electrochemistry, Jun. 1, 2005, vol. 35, pp. 1283-1292.
Bäumer et al., "Cleavage of olefinic double bonds by mediated anodic oxidation", Electrochimica Acta, vol. 48, 2003, pp. 489-495.
European Search Report received for European Patent Application No. 22164784.5, mailed on Nov. 17, 2022, 8 pages.
Gütz et al., "Electrochemical Screening for Electroorganic Synthesis", Org. Process Res. Dev., vol. 20, 2016, pp. 26-32.
International Search Report received for PCT Application No. PCT/EP2023/057341, mailed on Jul. 17, 2023, 8 pages with English translation.
Kirste et al., "Anodic Phenol-Arene Cross-Coupling Reaction on Boron-Doped Diamond Electrodes", Angew. Chem. Int. Ed., vol. 49, 2010, pp. 971-975.
Kirste et al., "Anodische Phenol-Aren-Kreuzkupplung an bordotierten Diamant-elektroden", Angew. Chem., vol. 122, 2010, pp. 983-987.
Torii et al., "Electrooxidative Cleavage of Carbon-Carbon Linkages. 1. Preparation of Acyclic Oxoalkanoates from 2-Hydroxy- and 2-Acetoxy-1-cycloalkanones and Cycloalkanone Enol Acetates", J. Org. Chem., vol. 47, No. 1, 1982, pp. 47-52.
Written Opinion received for PCT Application No. PCT/EP2023/057341, mailed on Jul. 17, 2023, 11 pages with English translation.
U.S. Appl. No. 17/611,251, filed Nov. 15, 2021, 2022/0227932, Weinelt et al.
U.S. Appl. No. 18/850,115, filed Sep. 24, 2024, 2025/0215583, Baumann et al.
U.S. Appl. No. 18/849,121, filed Sep. 20, 2024, 2025/0109509, Weinelt et al.
U.S. Appl. No. 18/849,610, filed Sep. 23, 2024, 2025/0223709, Weinelt et al.

* cited by examiner

*Primary Examiner* — Wojciech Haske
(74) *Attorney, Agent, or Firm* — Grüneberg Global IP, PLLC

(57) ABSTRACT

A process produces unsubstituted or at least monosubstituted α,ω-dicarboxylic acids and ketocarboxylic acids by electrochemical oxidation of unsubstituted or at least monosubstituted, monounsaturated or polyunsaturated cycloalkenes by electrochemical oxidation in the presence of an inorganic or organic nitrate salt in an electrolysis cell in a reaction medium in the presence of oxygen.

48 Claims, No Drawings

ELECTROCHEMICAL OXIDATION OF CYCLOALKENES TO FORM ALPHA, OMEGA-DICARBOXYLIC ACIDS AND KETOCARBOXYLIC ACIDS

CROSS-REFERENCE TO RELATED APPLICATIONS

This application is a National Stage entry under § 371 of International Application No. PCT/EP2023/057341, filed on Mar. 22, 2023, and which claims the benefit of priority to European Patent Application No. 22164784.5, filed on Mar. 28, 2022. The content of each of these applications is hereby incorporated by reference in its entirety.

BACKGROUND OF THE INVENTION

Field of the Invention

The present invention relates to a process for producing unsubstituted or at least monosubstituted α,ω-dicarboxylic acids and ketocarboxylic acids by electrochemical oxidation of unsubstituted or at least monosubstituted, monounsaturated or polyunsaturated cycloalkenes by electrochemical oxidation in the presence of an inorganic or organic nitrate salt in an electrolysis cell in a reaction medium in the presence of oxygen.

Description of Related Art

α,ω-Dicarboxylic acids and ketocarboxylic acids are important substrates for organic synthetic chemistry and monomer components for polymer syntheses and are therefore highly relevant to industrial applications. The conventional route to these substrates from cycloalkenes is essentially via transition metal-catalyzed reactions and using chemical oxidants.

Only a few electrochemical processes for synthesis of dicarboxylic acid from cycloalkenes by direct C=C bond cleavage have hitherto been described. The known processes are typically mediated and also employ costly transition metal catalysts. They typically require an additional oxidant which is electrochemically regenerated (CN 101092705A; U.-St. Bäumer, H. J. Schäfer, J. Appl. Electrochem. 2005, 35, 1283-1292). Furthermore, toxic transition metals/oxides thereof are typically used as electrode materials (S. Toril, T. Inokuchi, R. Oi, J. Org. Chem. 1982, 47, 47-52; D. D. Davis, D. L. Sullivan, Process for the Preparation of Dodecanedionic Acid, 1991, U.S. Pat. No. 5,026,461 A). Divided cells are often used, thus resulting in a more complex cell construction (CN 101092705A). Known methods which do not require additional transition metal catalysts are potentiostatic, require biphasic mixtures and give poor current yields, so that scalability and economy cannot be ensured (S. Torii, T. Inokuchi, R. Oi, J. Org. Chem. 1982, 47, 47-52; U. Baumer, Electrochimica Acta 2003, 48, 489-495).

Furthermore, the processes known from the prior art provide a route to only a small substrate spectrum or require pre-functionalization. In addition, the prior art predominantly describes synthesis of the corresponding carboxylic esters, so that generation of the carboxylic acids requires a further step of hydrolysis which requires additional time and resources.

Due to elevated material input the use of costly transition metals as electrocatalysts or as electrode materials and the use of chemical oxidants, often in excess, result in generated reagent wastes which in some cases require costly and complex disposal or regeneration.

SUMMARY OF THE INVENTION

It is an object of the present invention to provide a sustainable and resource-saving process which makes it possible to produce α,ω-dicarboxylic acids and ketocarboxylic acids from cycloalkenes.

This object was achieved by the subject-matter of the embodiments and by the description herein.

The present invention provides a process for producing unsubstituted or at least monosubstituted α,ω-dicarboxylic acids or ketocarboxylic acids by electrochemical oxidation of unsubstituted or at least monosubstituted, monounsaturated or polyunsaturated cycloalkenes comprising the process steps of:

(a) providing at least one unsubstituted or at least monosubstituted, monounsaturated or polyunsaturated cycloalkene;

(b) providing at least one organic nitrate salt;

(c) electrochemically oxidizing the unsubstituted or at least monosubstituted, monounsaturated or polyunsaturated cycloalkene provided in step (a) in the presence of the organic nitrate salt provided in step (b) in an electrolysis cell in a reaction medium in the presence of oxygen.

The process of the invention has the particular features of high selectivity, small amounts of auxiliary chemicals used, the use of electric current as oxidizing agent and, associated therewith, the generation of smaller amounts of waste products.

It has surprisingly been found that the process according to the invention for electrochemical oxidation makes it possible to use atmospheric oxygen to introduce the oxygen function into cycloalkenes. This makes it possible to dispense with the use of chemical oxidants such as reactive peroxides and costly catalysts with complex ligand systems. At the same time, the use of toxic and/or potentially carcinogenic substances can be reduced or even avoided altogether. The method that has been developed represents an inexpensive and environmentally friendly alternative to existing syntheses. The simple and safe process conditions allow for scaling up to an industrial scale, so that larger amounts of the desired products may also be produced. The present invention thus allows previously cost- and time-intensive processes to be substantially optimized.

It has surprisingly also been found that the process according to the invention makes it possible to use electrical current to produce unsubstituted or at least monosubstituted α,ω-dicarboxylic acids and ketocarboxylic acids from cycloalkenes using nitrate salts which function both as a conducting salt and as an electrochemical mediator.

It has surprisingly further been found that the process according to the invention may be performed at ambient pressure and ambient temperature which is likewise advantageous for energy efficiency and thus also for environmental compatibility.

The process according to the invention may employ unsubstituted or at least monosubstituted, monounsaturated or polyunsaturated cycloalkenes which are monocyclic or bicyclic. It is preferable to employ unsubstituted or at least monosubstituted, monounsaturated or polyunsaturated monocyclic cycloalkenes, wherein unsubstituted or at least monosubstituted, monounsaturated monocyclic cycloalkenes are particularly preferred. The cycloalkenes employed according to the invention comprise endocyclic, unsaturated bonds.

DETAILED DESCRIPTION OF THE INVENTION

The unsubstituted or at least monosubstituted, monounsaturated or polyunsaturated monocyclic cycloalkenes employed in the process according to the invention may preferably have 5 to 12 carbon atoms, particularly preferably 6 to 12 carbon atoms, very particularly preferably 8 to 12 carbon atoms, in the ring system. These cycloalkenes may be monounsaturated or polyunsaturated, wherein monounsaturated cycloalkenes are preferred. These cycloalkenes may each be unsubstituted or monosubstituted or polysubstituted. Where they are monosubstituted or polysubstituted, they are preferably substituted with 1, 2, 3, 4 or 5 substituents, each independently selected from the group consisting of methyl, phenyl or benzyl. The phenyl or benzyl substituents may themselves each be unsubstituted or monosubstituted or polysubstituted with 1, 2 or 3 substituents, each independently selected from the group consisting of F, Cl, Br and $NO_2$.

The unsubstituted or at least monosubstituted, monounsaturated or polyunsaturated bicyclic cycloalkenes employed in the process according to the invention may preferably have 7 to 18 carbon atoms, particularly preferably 7 to 12 carbon atoms, very particularly preferably 7 to 10 carbon atoms, in the ring system. These cycloalkenes may be monounsaturated or polyunsaturated, wherein monounsaturated cycloalkenes are preferred. These cycloalkenes may each be unsubstituted or monosubstituted or polysubstituted. Where they are monosubstituted or polysubstituted, they are preferably substituted with 1, 2, 3, 4 or 5 substituents, each independently selected from the group consisting of methyl, phenyl or benzyl. The phenyl or benzyl substituents may themselves each be unsubstituted or monosubstituted or polysubstituted with 1, 2 or 3 substituents, each independently selected from the group consisting of F, Cl, Br and $NO_2$.

The cycloalkene may very particularly preferably be selected from the group consisting of cyclohexene, cycloheptene, cyclooctene, cyclononene, cyclodecene, cycloundecene, cyclododecene, 1-phenylcyclohex-1-ene, bicyclo [2.2.1]hept-2-ene, α-pinene and carene.

Step (b) of the process according to the invention comprises providing at least one organic nitrate salt. This nitrate salt functions both as the conducting salt and as the mediator of the electrochemical oxidation process according to the invention. Preference is given to using an organic salt of the general formula $$[\text{cation}^+][NO_3^-]$$

where the [cation$^+$] is selected from the group consisting of ammonium ions having the general structure $[R^1R^2R^3R^4N^+]$ where $R^1$, $R^2$, $R^3$ and $R^4$ are each independently selected from the group consisting of $C_1$ to $C_{16}$ alkyl, especially $C_1$ to $C_8$ alkyl, straight-chain or branched, imidazolium cations of the general structure (I)

(I)

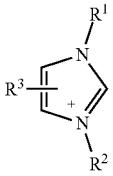

where $R^{1'}$ and $R^{2'}$ are each independently selected from the group consisting of $C_1$ to $C_{18}$ alkyl, straight-chain or branched, especially $C_1$ to $C_8$ alkyl, straight-chain or branched, and $R^{3'}$ is selected from the group consisting of H and $C_1$ to $C_{18}$ alkyl, straight-chain or branched, especially from the group consisting of H and $C_1$ to $C_8$ alkyl, straight-chain or branched, pyridinium cations of the general structure (II)

(II)

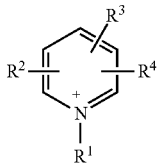

where $R^{1''}$ is selected from the group consisting of $C_1$ to $C_{18}$ alkyl, especially $C_1$ to $C_8$ alkyl, straight-chain or branched and $R^{2''}$, $R^{3''}$ and $R^{4''}$ are each independently selected from the group consisting of H and $C_1$ to $C_{18}$ alkyl, straight-chain or branched, especially from the group consisting of H and $C_1$ to $C_{18}$ alkyl, straight-chain or branched, and phosphonium ions of the general structure $[R^{1a}R^{2a}R^{3a}R^{4a}P^+]$ where $R^{1a}$, $R^{2a}$, $R^{3a}$, $R^{4a}$ are each independently selected from the group consisting of $C_1$ to $C_{16}$ alkyl, especially $C_1$ to $C_8$ alkyl, straight-chain or branched.

Where an organic nitrate based on imidazolium cations is used in the process according to the invention, preference is given to cations of the general formula (I) in which $R^{1'}$ and $R^{2'}$ are each independently selected from the group consisting of $C_1$ to $C_{18}$ alkyl, straight-chain or branched, especially $C_1$ to $C_8$ alkyl, straight-chain or branched and $R^{3'}$ is hydrogen. Particularly preferred are imidazolium cations of the general formula (I) in which $R^{1'}$ is methyl and $R^{2'}$ is ethyl or $R^{1'}$ is methyl and $R^{2'}$ is methyl or $R^{1'}$ is methyl and $R^{2'}$ is butyl and $R^{3'}$ is hydrogen in each case.

Where a nitrate based on pyridinium cations is used in the process according to the invention, preference is given to cations of the general formula (II) in which $R^{1''}$ is $C_1$- to $C_{18}$-alkyl, straight-chain or branched, especially $C_1$- to $C_8$-alkyl, straight-chain or branched. Particularly preferred are pyridinium cations of the general formula (II) in which $R^{1''}$ is $C_1$- to $C_{18}$-alkyl, straight-chain or branched, especially $C_1$- to $C_8$-alkyl, straight-chain or branched, and the radicals $R^{2''}$, $R^{3''}$ and $R^{4''}$ are each independently selected from the group consisting of $C_1$- to $C_8$-alkyl, straight-chain or branched, wherein monosubstitution in the 2-, 3- or 4-position, disubstitution in the 2,4-, 2,5 or 2,6-position or trisubstitution in the 2,4,6-position is preferred.

It is in principle also possible to use two or more of the abovementioned nitrate salts in the process according to the invention. It is preferable to employ a nitrate salt according to the invention, in particular an organic ammonium nitrate salt of composition $[R^1R^2R^3R^4N^+][NO_3^-]$ or an organic phosphonium salt of composition $[R^{1a}R^{2a}R^{3a}R^{4a}P^+][NO_3^-]$, wherein an organic ammonium nitrate salt of composition $[R^1R^2R^3R^4N^+][NO_3^-]$ is particularly preferred.

It is very particularly preferable when the organic ammonium nitrate salt is tetra-n-butylammonium nitrate or methyltri-n-octylammonium nitrate. The organic phosphonium nitrate salt is very particularly preferably tetra-n-butylphosphonium nitrate or methyltri-n-octylphosphonium nitrate. The organic imidazolium nitrate salt is preferably 1-butyl-3-methylimidazolium nitrate.

The organic nitrate salt employed in the process according to the invention is most preferably tetra-n-butylammonium nitrate or methyltri-n-octylammonium nitrate.

The sequence in which the components used in the process according to the invention are provided may vary, as can the sequence in which the individual components are brought into contact with each other or with the respective reaction medium.

In one embodiment of the process according to the invention, the unsubstituted or at least monosubstituted, monounsaturated or polyunsaturated cycloalkene or the inorganic or organic nitrate salt are initially charged and combined with the reaction medium, preferably at least partially or completely dissolved in the reaction medium or mixed therewith, and the other of these two components in each case is subsequently added. In a further embodiment of the process according to the invention, the unsubstituted or at least monosubstituted, monounsaturated or polyunsaturated cycloalkene and the inorganic or organic nitrate salt are initially charged and subsequently combined with the reaction medium, preferably partially or completely dissolved in the reaction medium or mixed therewith. It is further also possible that in the process according to the invention the unsubstituted or at least monosubstituted, monounsaturated or polyunsaturated cycloalkene and the inorganic or organic nitrate salt are added to the reaction medium, preferably at least partially or completely dissolved in the reaction medium or mixed therewith, simultaneously or consecutively The reaction medium used in the process according to the invention is liquid under the conditions under which the process is carried out and is capable of partially or completely dissolving the components used, i.e. especially the unsubstituted or at least monosubstituted, monounsaturated or polyunsaturated cycloalkene and the inorganic or organic nitrate salt. Where at least one of these components is used in liquid form, the reaction medium is preferably readily miscible with said component(s).

The process according to the invention preferably employs a polar aprotic reaction medium for the electrochemical oxidation. This may be employed in anhydrous form, in dried form or else in combination with water.

Where an inorganic nitrate salt, especially potassium nitrate or sodium nitrate, is used in the process according to the invention, the reaction medium advantageously contains water, preference being given to an aprotic reaction medium in combination with water. The water content in the reaction medium may vary. The water content is preferably up to 20% by volume, particularly preferably up to 15% by volume, very particularly preferably up to 10% by volume, yet more preferably up to 5% by volume, in each case based on the total amount of reaction medium.

The polar aprotic reaction medium is preferably selected from the group consisting of aliphatic nitriles, aliphatic ketones, cycloaliphatic ketones, dialkyl carbonates, cyclic carbonates, lactones, aliphatic nitroalkanes, dimethyl sulfoxide, esters and ethers or a combination of at least two of these components.

The reaction medium is particularly preferably selected from the group consisting of acetonitrile, isobutyronitrile, adiponitrile, acetone, dimethyl carbonate, methyl ethyl ketone, 3-pentanone, cyclohexanone, nitromethane, nitropropane, tert-butyl methyl ether, dimethyl sulfoxide, gamma-butyrolactone and epsilon-caprolactone or a combination of at least two of these components.

The reaction medium is very particularly preferably selected from the group consisting of acetonitrile, isobutyronitrile, adiponitrile, dimethyl carbonate and acetone or a combination of at least two of these components.

The reaction medium is very particularly preferably acetonitrile, isobutyronitrile or adiponitrile in dried or anhydrous form.

The reaction medium is likewise very particularly preferably acetonitrile, isobutyronitrile or adiponitrile, optionally in combination with water.

Where one or more of the abovementioned components is used in the reaction medium in combination with water, the water content is preferably up to 20% by volume, particularly preferably up to 15% by volume, very particularly preferably up to 10% by volume, yet more preferably up to 5% by volume, in each case based on the total amount of reaction medium.

To perform the process according to the invention it may be advantageous to add further solubilizing components to the reaction medium. Suitable advantageous components may be identified through simple preliminary tests of dissolution behaviour.

Examples of solubilizing components are primary alcohols, secondary alcohols, monoketones or dialkyl carbonates or mixtures of at least two of these components, optionally in combination with water. The process according to the invention may preferably employ $C_{1-6}$ alcohols, wherein particularly preferred solubilizing components may be selected from the group consisting of methanol, ethanol, isopropanol, 2-methyl-2-butanol or mixtures of at least two of these components, optionally in combination with water.

The reaction medium employed may particularly advantageously be dimethyl carbonate, optionally in combination with at least one $C_{1-6}$ alcohol, in particular selected from the group consisting of methanol, ethanol, isopropanol and 2-methyl-2-butanol, optionally in combination with water.

Where one or more of these solubilizing components is used in combination with water, the water content is preferably up to 20% by volume, particularly preferably up to 15% by volume, very particularly preferably up to 10% by volume, yet more preferably up to 5% by volume, in each case based on the total amount of solubilizing component and water.

The solubilizing components may be added in amounts of preferably <50% by volume, particularly preferably of <30% by volume, very particularly preferably of <10% by volume, in each case based on the total amount of reaction medium.

It is preferable when the process according to the invention employs the inorganic or organic nitrate salt in an amount of 0.1 to 2.0, preferably 0.2 to 1.0, particularly preferably 0.3 to 0.8 and very particularly preferably 0.4 to 0.8, equivalents, in each case based on the amount of unsubstituted or at least monosubstituted, monounsaturated or polyunsaturated cycloalkene.

According to the invention, the electrochemical oxidation of the unsubstituted or at least monosubstituted, monounsaturated or polyunsaturated cycloalkene is carried out in the presence of the inorganic or organic nitrate salt in an electrolysis cell in a reaction medium in the presence of oxygen.

To this end a gas atmosphere containing oxygen is advantageously provided in spatial connection with the reaction medium.

The proportion of oxygen in the gas atmosphere may vary. The proportion of oxygen in the gas atmosphere is preferably 10% to 100% by volume, particularly preferably 15% to 30% by volume, particularly preferably 15% to 25% by volume, very particularly preferably 18% to 22% by volume.

In one embodiment, the proportion of oxygen in the gas atmosphere may be 10% to 100% by volume, particularly preferably 15% to 100% by volume, particularly preferably 20% to 100% by volume.

It is very particularly preferable when the gas atmosphere is air.

It is advantageous when gas exchange between the gas atmosphere and the reaction medium is forced, preferably by introducing gas atmosphere into the reaction medium or by stirring the liquid phase in the presence of the gas atmosphere.

The gas exchange between the gas atmosphere and the reaction medium, especially the stirring, can be used to control the electrochemical oxidation, for example via the geometry of the stirrer or the stirrer speed.

The amount of oxygen dissolved in the reaction medium is preferably at least 1 mmol/L of reaction medium, particularly preferably at least 5 mmol/L of reaction medium.

It is likewise preferable when the amount of oxygen dissolved in the reaction medium is at least 10 mmol/L of reaction medium.

The process according to the invention for producing unsubstituted or at least monosubstituted α,ω-dicarboxylic acids and ketocarboxylic acids by electrochemical oxidation of unsubstituted or at least monosubstituted, monounsaturated or polyunsaturated cycloalkenes in the presence of an inorganic or organic nitrate salt in an electrolysis cell in a reaction medium in the presence of oxygen may be performed either in a divided electrolysis cell or in an undivided electrolysis cell, wherein performance in an undivided electrolysis cell is preferred.

The undivided electrolysis cell preferably used according to the invention has at least two electrodes. Anodes and cathodes made of customary materials may be used for this purpose, for example ones made of glassy carbon, boron-doped diamond (BDD) or graphite. The use of glassy carbon electrodes is preferred.

The undivided electrolysis cell preferably comprises at least one glassy carbon anode or at least one glassy carbon cathode. It is preferable when both the anode and the cathode are glassy carbon electrodes.

The distance between the electrodes may vary over a certain range. The distance is preferably 0.1 mm to 2.0 cm, particularly preferably 0.1 mm to 1.0 cm, particularly preferably 0.1 mm to 0.5 cm.

The process according to the invention may further be performed batchwise or continuously, preferably in an undivided flow-through electrolysis cell.

It is preferable when the process according to the invention is performed with a charge quantity of at least 190 C (2 F) to 970 C (10 F), preferably 290 C (3 F) to 870 C (9 F), particularly preferably 330 C (3.5 F) to 820 C (8.5 F), very particularly preferably 380 C (4 F) to 775 C (8 F), most preferably 380 C (4 F) to 580 C (6 F), in each case for 1 mmol of employed unsubstituted or at least monosubstituted, monounsaturated or polyunsaturated cycloalkene.

The electrochemical oxidation in the process according to the invention is preferably carried out at constant current.

The current density at which the process according to the invention is carried out is preferably at least 5 mA/cm$^2$ or at least 10 mA/cm$^2$ or at least 15 mA/cm$^2$ or at least 20 mA/cm$^2$, or 20 mA/cm$^2$ to 50 mA/cm$^2$, wherein the reported surface area refers to the geometric area of the electrodes.

An important advantage of the process according to the invention is that the oxidant employed is electric current, which is a particularly environmentally friendly agent when it derives from renewable sources, i.e. especially from biomass, solar thermal energy, geothermal energy, hydropower, wind power or photovoltaics in particular.

The process according to the invention may be performed over a wide temperature range, for example at a temperature in the range from 0° to 60° C., preferably of 5° C. to 50° C., particularly preferably 10° C. to 40° C., very particularly preferably at 15° C. to 30° C.

The process according to the invention may be performed at elevated or reduced pressure. Where the process according to the invention is performed at elevated pressure, a pressure up to 16 bar is preferred and a pressure up to 6 bar is particularly preferred.

The process according to the invention may likewise preferably be performed at atmospheric pressure.

The products produced by the process according to the invention may be isolated/purified by customary processes known to those skilled in the art, especially by extraction, crystallization, centrifugation, precipitation, distillation, evaporation or chromatography.

The following examples further elucidate the present invention but are not intended to limit the scope of the invention.

GENERAL INFORMATION AND METHODS

Chemicals of analytical quality were obtained from commonly used suppliers (such as TCI, Aldrich and Acros) and used. Oxygen was obtained in 2.5 quality from Nippon Gases Deutschland GmbH, Düsseldorf, Germany and used as is.

The electrode material used was glassy carbon (Sigradur® G, from HTW Hochtemperatur Werkstoffe GmbH, Thierhaupten, Germany).

High-performance liquid chromatography was carried out on a Shimadzu HPLC-MS instrument with a SIL 20A HT autosampler, a CTO-20AC column oven, two LC-20AD pump modules for adjusting the eluent gradient, a SPD-M20A diode array detector, a CBM-20A system controller and a Eurospher II 100-5 $C_{18}$ column (150×4 mm, Knauer, Berlin). Eluent: Acetonitrile/water/formic acid (1% by volume) (from 10% ACN to 90% ACN in 10 min+10 min 100% ACN). Mass spectrometric measurements were carried out on a LCMS-2020 instrument from Shimadzu, Japan.

1H-NMR and 13C-NMR spectra were recorded at 25° C. with a Bruker Avance II 400 (400 MHZ, 5 mm BBFO probe with Z-gradient and ATM, SampleXPress 60 autosampler, Analytische Messtechnik, Karlsruhe, Germany).

Gas Introduction for GP1/GP2/GP3:

Gas introduction was effected in controlled fashion via two model 5850S mass-flow controllers (MFCs) from Brooks Instrument B.V., Veenendaal, The Netherlands. One controller was used for introduction of oxygen and one controller was used for introduction of nitrogen. The controllers were controlled by means of Smart DDE and Matlab R2017b software. Volume flows were additionally monitored via a DK800 float-principle flowmeter from Krohne Messtechnik GmbH, Duisburg. For all experiments performed the overall volume flow was a constant 20 mL/min, which, limited by the MFCs used, also represents the maximum achievable volume flow. The percent volume flows of the two gases were adjusted using the MFCs and their software. Gas cylinders from the following suppliers were used: Oxygen 2.5 from Nippon Gases Deutschland GmbH, Düsseldorf, and nitrogen 4.8 from Westfalen AG, Münster or nitrogen 5.0 from Nippon Gases Deutschland GmbH, Düsseldorf. In this regard the apparatus was provided with a gas distributor including gas adapter and also (Teflon) lids for the electrolysis cells.

General Procedure GP1

The undivided Teflon cells used for the electrolysis are described in the literature (a) C. Gütz, B. Klöckner, S. R. Waldvogel, Org. Process Res. Dev. 2016, 20, 26-32; b) A. Kirste, G. Schnakenburg, F. Stecker, A. Fischer, S. R. Waldvogel, Angew. Chem. Int. Ed. 2010, 49, 971-975; Angew. Chem. 2010, 122, 983-987. (see SI).) The full range of these cells with a stainless steel block is also commercially available as the IKA Screening System (IKA-Werke GmbH & Co. KG, Staufen, Germany). The electrode dimensions were 7 cm×1 cm×0.3 cm.

In an undivided 5 ml. Teflon pot cell the cycloalkane (1.0 mmol) and tetrabutylammonium nitrate (0.5 equiv.) were initially charged and dissolved in acetonitrile (5 mL). The cell was fitted with glassy carbon electrodes spaced 0.5 cm apart. The immersed surface area of the electrodes was 1.8 $cm^2$. After the cell was secured in a stainless steel block a galvanostatic electrolysis was performed at 5° C. at a current density of 10 $mA/cm^2$.

After employing a charge quantity of 4 to 8 F in respect of the cycloalkene the solvent was initially removed by distillation. The conductivity salt was then removed by extraction using 10 ml of ethyl acetate and 10 ml of water. The organic phase was washed with an aqueous NaOH solution (1 M, 10 mL). The aqueous phase was the adjusted to pH 1 with an aqueous HCl solution (1 M) and said phase was extracted with 2×10 ml of ethyl acetate. After drying the organic phase over calcium chloride and distillative removal of the solvent, the obtained product was dried under high vacuum. To the extent there is any divergence from GP1, for example in terms of the solvent, this is apparent from the examples which follow.

General Procedure GP2

The undivided Teflon cells used for the electrolysis are described in the literature (a) C. Gütz, B. Klöckner, S. R. Waldvogel, Org. Process Res. Dev. 2016, 20, 26-32; b) A. Kirste, G. Schnakenburg, F. Stecker, A. Fischer, S. R. Waldvogel, Angew. Chem. Int. Ed. 2010, 49, 971-975; Angew. Chem. 2010, 122, 983-987. (see SI).) The full range of these cells with a stainless steel block is also commercially available as the IKA Screening System (IKA-Werke GmbH & Co. KG, Staufen, Germany). The dimensions of the electrodes were 7 cm×1 cm×0.3 cm.

In an undivided 5 mL Teflon pot cell the cycloalkane (0.1-1.0 mmol) and tetrabutylammonium nitrate (0.5-2.0 eq.) were initially charged and dissolved in acetonitrile (5 mL). The cell was fitted with glassy carbon electrodes spaced 0.5 cm apart. The immersed surface area of the electrodes was 1.8 $cm^2$. After the cell was secured in a stainless steel block a galvanostatic electrolysis was performed at a current density of 5-10 $mA/cm^2$ at 5-50° C.

After employing a charge quantity of 4 to 8 F in respect of the cycloalkene the solvent was initially removed by distillation. The conductivity salt was then removed by extraction using 10 ml of ethyl acetate and 10 mL of an aqueous HCl solution (0.1 M). The solvent of the organic phase is removed by distillation and the residue taken up in an aqueous NaOH solution (1 M, 10 mL) and washed with 10 mL of diethyl ether or 10 mL of n-pentane. The aqueous phase was then adjusted to pH 1 dropwise with concentrated aqueous HCl solution and said phase was extracted with 2×10 ml of ethyl acetate. After drying the organic phase over magnesium sulfate and distillative removal of the solvent, the obtained product was dried under high vacuum. To the extent there is any divergence from GP1, for example in terms of the solvent, this is apparent from the examples which follow.

General Procedure GP3

The electrolysis were performed in an undivided flow-through cell (IKA, electrode area: 2 cm×6 cm). To this end the cycloalkene (0.5-5 mmol), and the conducting salt (0.4 to 1.0 eq.) were dissolved in the solvent (5-10 mL) in a reservoir (20 mL snap-cap vial). The temperature of the reservoir was 20-50° C. The reaction solution was conveyed at a flow rate of 5-18 mL/min using a peristaltic pump into a Y-piece or T-piece into which oxygen gas (100% by volume) was introduced at a flow rate of 10-20 mL/min. This segmented flow was conveyed onwards into the cell (electrode distance: 0.05 cm). After flowing through the cell the reaction solution was returned to the reservoir where it was re-aspirated. The electrolysis was carried out at constant current (5-20 $mA/cm^2$) and a charge quantity of 2-4 F based on the substrate. After the electrolysis 1,3,5-trimethoxybenzene was added to the reaction solution as GC standard (previously: external calibration of the substrate to be analyzed). 3 drops of the reaction solution were eluted through about 330 mg of silica gel 60 M using ethyl acetate. About 1.5 mL of the filtrate was collected in a GC vial and analysed for residual reactant by GC-FID. The yield determination of the dicarboxylic acid was carried out via an extractive isolation: The solvent of the organic phase was removed by distillation and the residue taken up in an aqueous NaOH solution. (1 M, 10 mL) and washed with 10 ml of diethyl ether or 10 mL of n-pentane. The aqueous phase was then adjusted to pH 1 dropwise with concentrated aqueous HCl solution and said phase was extracted with 2×10 ml of ethyl acetate. After drying the organic phase over sodium sulfate and distillative removal of the solvent, the dicarboxylic acid product was dried under high vacuum.

Example 1

Production of 1,6-Hexanedioic Acid.

According to GP1, cyclohexene (0.082 g, 1.0 mmol, 1.0 eq.) was subjected to galvanostatic electrolysis under an oxygen atmosphere (100% by volume) and application of 8 F. Distillative removal of the solvent and drying under high vacuum afforded the product as a colourless solid (yield: 16%, 0.023 g, 0.16 mmol). 1H-NMR (400 MHZ, DMSO-d6) δ [ppm]=12.00 (s, 2H); 2.22-2.18 (m, 4H); 1.51-1.47 (m, 4H). The analytical data are in agreement with the literature values.

Example 2

Production of 1,8-octanedioic Acid

According to GP1, cyclooctene (0.110 g, 1.0 mmol, 1.0 eq.) was subjected to galvanostatic electrolysis under an oxygen atmosphere (100% by volume) and application of 4 F. Distillative removal of the solvent and drying under high vacuum afforded the product as a colourless solid (yield: 47%, 0.082 g, 0.47 mmol). 1H-NMR (400 MHZ, DMSO-d6) ¿ [ppm]=11.98 (s, 2H); 2.18 (t, J=7.4 Hz, 4H); 1.49-1.46 (m, 4H); 1.27-1.24 (m, 4H). The analytical data are in agreement with the literature values.

Example 3

Production of 1,12-Dodecanedioic Acid

According to GP1, cyclododecene (0.166 g, 1.0 mmol, 1.0 eq.) was subjected to galvanostatic electrolysis under an oxygen atmosphere (100% by volume) and application of 8 F. Isobutyronitrile (5 ml) was used as solvent. Distillative removal of the solvent and drying under high vacuum afforded the product as a colourless solid (yield: 53%, 0.121 g, 0.53 mmol). $^1$H-NMR (400 MHZ, DMSO-d6) δ[ppm] =11.98 (s, 2H), 2.18 (t, J=7.6 Hz, 4H); 1.51-1.46 (m, 4H); 1.24 (s, 12H). The analytical data are in agreement with the literature values.

Example 4

Production of 6-Oxo-6-Phenylhexanoic Acid

According to GP1, 1-phenylcyclohex-1-ene (0.158 g, 1.0 mmol, 1.0 eq.) was subjected to galvanostatic electrolysis under an oxygen atmosphere (100% by volume) and application of 4 F. Distillative removal of the solvent and drying under high vacuum afforded the product as a colourless solid (yield: 16%, 0.034 g, 0.16 mmol). 1H-NMR (400 MHZ, DMSO-d6) δ [ppm]=12.17 (s, 1H); 7.98-7.93 (m, 2H); 7.65-7.60 (m, 1H); 7.53-7.50 (m, 2H); 3.03 (t, J=7.0 Hz, 2H); 2.25 (t, J=7.0 Hz, 2H); 1.66-1.52 (m, 4H). The analytical data are in agreement with the literature values.

Example 5

1,3-Cyclopentanedioic Acid

According to GP1, bicylo[2.2.1]hept-2-ene (0.094 g, 1.0 mmol, 1.0 eq.) was subjected to galvanostatic electrolysis under an oxygen atmosphere (100% by volume) and application of 4 F. Distillative removal of the solvent and drying under high vacuum afforded the product as a colourless, high-viscosity liquid (yield: 20%, 0.031 g, 0.20 mmol).

1H-NMR (400 MHZ, DMSO-d6) δ[ppm]=12.14 (s, 2H); 2.78-2.62 (m, 2H); 2.13-2.06 (m, 1H); 1.88-1.72 (m, 5H). 13C-NMR (101 MHz, DMSO-d6) δ [ppm]=176.4; 43.3; 32.8; 28.9.

Example 6

The following examples describe additional syntheses of 1,8-octanedioic acid according to scheme 1 using GP1/GP2.

Scheme 1

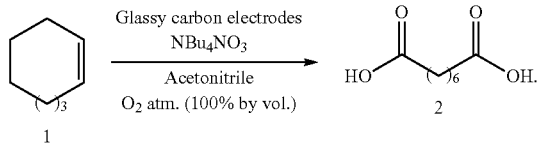

TABLE 1

Additional 1,8-octanedioic acid syntheses.

| Example No. | Divergence from standard conditions[a] | 1/% (unconverted, GC) | 2/% (isolated) |
|---|---|---|---|
| 6-GP1-01 | None | Not specified | 40 |
| 6-GP1-02 | 100% $N_2$ atm., 4 F | Not specified | 0 |
| 6-GP2-03 | 35° C., 1 (0.25 mmol), 4 F, 5 mA/cm$^2$ | 20 | 41 |
| 6-GP2-04 | 35° C., 1 (0.25 mmol), 6 F, 5 mA/cm$^2$ | 18 | 44 |
| 6-GP2-05 | 35° C., 1 (0.25 mmol), 8 F, 5 mA/cm$^2$ | 12 | 39 |
| 6-GP2-06 | 35° C., 1 (0.25 mmol), 8 F, 5 mA/cm$^2$, isobutyronitrile (5 mL) | 13 | 46 |

[a]Standard conditions: GC||GC, acetonitrile (5 mL), $NBu_4NO_3$ (0.5 equiv.), 5° C., 350 rpm, 1 (1 mmol), 100% $O_2$ atm., 5 F, 10 mA/cm$^2$.

Example 7

The following examples describe additional syntheses of 1,12-dodecanedioic acid according to scheme 2 using GP1/GP2.

Scheme 2

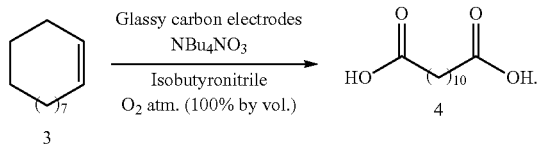

TABLE 2

Additional 1,12-dodecanedioic acid syntheses in batch.

| Example No. | Divergence from standard conditions[a] | 3/% (unconverted, GC) | 4/% (isolated) |
|---|---|---|---|
| 7-GP1-01 | None | No data | 33 |
| 7-GP2-02 | 22° C., 3 (0.5 mmol), $NBu_4NO_3$ (1 eq.), 8 F | 0 | 61 |
| 7-GP2-03 | 22° C., 3 (0.5 mmol), $NBu_4NO_3$ (2 eq.), 8 F | 0 | 71 |
| 7-GP2-04 | 22° C., 3 (0.5 mmol), $NBu_4NO_3$ (1 eq.), 8 F, 5 mA/cm$^2$ | 0 | 69 |
| 7-GP2-05 | 22° C., 3 (0.5 mmol), 8 F | 0 | 69 |
| 7-GP2-06 | 22° C., 3 (0.5 mmol), $NBu_4NO_3$ (1 eq.), 6 F, 5 mA/cm$^2$ | 1 | 66 |
| 7-GP2-07 | 22° C., 3 (0.375 mmol), $NBu_4NO_3$ (1.3 eq.), 8 F | 0 | 73 |
| 7-GP2-08 | 22° C., 3 (0.5 mmol), $NBu_4NO_3$ (1 eq.), 5 mA/cm$^2$ | 0 | 68 |
| 7-GP2-09 | 22° C., 3 (0.5 mmol), 6 F, 5 mA/cm$^2$ | 0 | 70 |
| 7-GP2-10 | 22° C., 3 (0.25 mmol), $NBu_4NO_3$ (2 eq.), 8 F | 0 | 76 |
| 7-GP2-11 | 22° C., 3 (0.25 mmol), 5 mA/cm$^2$ | 0 | 75 |
| 7-GP2-12 | 22° C., 3 (0.25 mmol) | 0 | 73 |
| 7-GP2-13 | 22° C., 3 (0.25 mmol), 2 F | 7 | 63 |
| 7-GP2-14 | 22° C., 3 (0.25 mmol), no current | 95 | 0 |
| 7-GP-15 | 35° C., 3 (0.25 mmol), 5 mA/cm$^2$ | 0 | 78 |
| 7-GP-16 | 50° C., 3 (0.25 mmol), 5 mA/cm$^2$ | 6 | 57 |
| 7-GP-17 | 5° C., 3 (0.25 mmol), 5 mA/cm$^2$ | 0 | 71 |
| 7-GP-18 | 35° C., 3 (0.25 mmol), 5 mA/cm$^2$, 200 rpm | 0 | 63 |
| 7-GP-19 | 35° C., 3 (0.25 mmol), 5 mA/cm$^2$, 500 rpm | 0 | 59 |
| 7-GP-20 | 35° C., 3 (0.1 mmol), 5 mA/cm$^2$ | No data | 61 |

[a]Standard conditions: GC||GC, acetonitrile (5 mL), $NBu_4NO_3$ (0.5 equiv.), 5° C., 350 rpm, 3 (1 mmol), 100% $O_2$ atm., 4 F, 10 mA/cm$^2$.

Examples 6-GP1-02 and 7-GP2-14 are comparative examples.

Example 8

The following examples describe additional syntheses of 1,12-dodecanedioic acid according to scheme 3 using GP3 which are performed in an electrochemical flow-through reactor.

Scheme 3

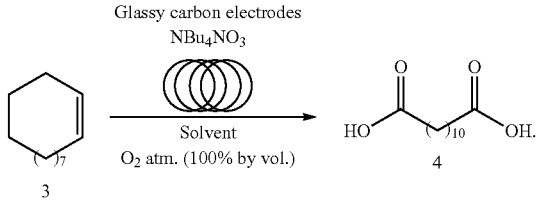

TABLE 3

Additional 1,12-dodecanedioic acid syntheses in flow-through reactor.

| Example No. | Divergence from standard conditions[a] | 3/% (unconverted, GC) | 4/% (isolated) |
|---|---|---|---|
| 8-GP3-01 | None | 0 | 76 |
| 8-GP3-02 | Dimethyl carbonate (4.5 mL), $O_2$ flow rate: 20 mL/min, 3 (2.5 mmol), 2 F, 10 mA/cm$^2$ | 21 | 35 |
| 8-GP3-03 | Dimethyl carbonate (4.3 mL) + methanol (5% by volume, 0.25 mL), electrolyte flow rate: 5 mL/min, 3 (2,5 mmol), $NBu_4NO_3$ (0.4 eq.), 2 F | 23 | 33 |
| 8-GP3-04 | Dimethyl carbonate (4.3 mL) + methanol (5% by volume, 0.25 mL), electrolyte flow rate: 18 mL/min, $O_2$ flow rate: 20 mL/min, 3 (2.5 mmol), $NBu_4NO_3$ (1 eq.), 2 F, 20 mA/cm$^2$ | 9 | 38 |

TABLE 3-continued

Additional 1,12-dodecanedioic acid syntheses in flow-through reactor.

| Example No. | Divergence from standard conditions[a] | 3/% (unconverted, GC) | 4/% (isolated) |
|---|---|---|---|
| 8-GP3-05 | Dimethyl carbonate (8.2 mL) + isopropanol (10% by volume, 0.92 mL), electrolyte flow rate: 18 mL/min, $O_2$ flow rate: 20 mL/min, 3 (5 mmol), $NBu_4NO_3$ (1 eq.), 2 F, 20 mA/cm$^2$ | 13 | 52 |

[a]Standard conditions: GC||GC isobutyronitrile (10 mL), $NBu_4NO_3$ (0.5 eq.), 20° C., electrolyte flow rate: 10 mL/min, flow rate 100% $O_2$: 10 mL/min, 3 (0.5 mmol), 4 F, 5 mA/cm$^2$.

The invention claimed is:

1. A process for producing unsubstituted or at least monosubstituted α,ω-dicarboxylic acids or ketocarboxylic acids by electrochemical oxidation of unsubstituted or at least monosubstituted, monounsaturated or polyunsaturated cycloalkenes, the process comprising:

(a) providing at least one unsubstituted or at least monosubstituted, monounsaturated or polyunsaturated cycloalkene;

(b) providing at least one organic nitrate salt;

(c) electrochemically oxidizing the unsubstituted or at least monosubstituted, monounsaturated or polyunsaturated cycloalkene provided in (a) in the presence of the at least one organic nitrate salt provided in (b) in an electrolysis cell in a reaction medium in the presence of oxygen, wherein substituents of the monounsaturated or polyunsaturated cycloalkenes are each independently selected from the group consisting of methyl, phenyl and benzyl substituents, wherein the phenyl and benzyl substituents are themselves each unsubstituted or monosubstituted or polysubstituted with 1, 2 or 3 substituents, each independently selected from the group consisting of F, Cl, Br and $NO_2$.

2. The process according to claim 1, wherein the unsubstituted or at least monosubstituted, monounsaturated or polyunsaturated cycloalkene is monocyclic.

3. The process according to claim 2, wherein the unsubstituted or at least monosubstituted, monounsaturated or polyunsaturated monocyclic cycloalkene has 5 to 12 carbon atoms in the ring system and is unsubstituted or monosubstituted or polysubstituted.

4. The process according to claim 2, wherein the unsubstituted or at least monosubstituted, monounsaturated or polyunsaturated bicyclic cycloalkene has 7 to 18 carbon atoms in the ring system and is unsubstituted or monosubstituted or polysubstituted, wherein each substituent is independently selected from the group consisting of methyl, phenyl and benzyl substituents, wherein the phenyl and benzyl substituents are themselves each unsubstituted or monosubstituted or polysubstituted with 1, 2 or 3 substituents, each independently selected from the group consisting of F, Cl, Br and $NO_2$.

5. The process according to claim 1, wherein the cycloalkene is selected from the group consisting of cyclohexene, cycloheptene, cyclooctene, cyclononene, cyclodecene, cycloundecene, cyclododecene, 1-phenylcyclohex-1-ene, bicylo[2.2.1]hept-2-ene, α-pinene and carene.

6. The process according to claim 1, wherein the organic nitrate salt present is a nitrate of formula [cation$^+$][$NO_3^-$], where [cation$^+$] is selected from the group consisting of ammonium ions having structure [$R^1R^2R^3R^4N^+$] where $R^1$, $R^2$, $R^3$, and $R^4$ are each independently selected from the group consisting of $C_1$ to $C_{16}$ alkyl, straight-chain or branched, imidazolium cations of structure (I)

(I)

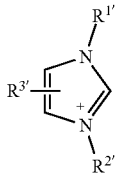

where $R^{1'}$ and $R^{2'}$ are each independently selected from the group consisting of $C_1$ to $C_{18}$ alkyl, straight-chain or branched, and $R^{3'}$ is selected from the group consisting of H and $C_1$ to $C_{18}$ alkyl, straight-chain or branched, pyridinium cations of structure (II)

(II)

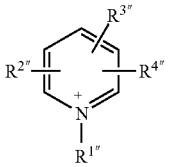

where $R^{1''}$ is selected from the group consisting of $C_1$ to $C_{18}$ alkyl, straight-chain or branched and $R^{2''}$, $R^{3''}$, and $R^{4''}$ are each independently selected from the group consisting of H and $C_1$ to $C_{18}$ alkyl, straight-chain or branched, and phosphonium ions of structure [$R^{1a}R^{2a}R^{3a}R^{4a}P^+$] where $R^{1a}$, $R^{2a}$, $R^{3a}$, $R^{4a}$ are each independently selected from the group consisting of $C_1$ to $C_{16}$ alkyl, straight-chain or branched.

7. The process according to claim 6, wherein, in the imidazolium cations of formula (I), the radicals $R^{1'}$ and $R^{2'}$ are each independently selected from the group consisting of $C_1$ to $C_{18}$ alkyl, straight-chain or branched, and $R^{3'}$ is hydrogen.

8. The process according to claim 6, wherein in the pyridinium cations of formula (II) the radical $R^{1''}$ is $C_1$ to $C_{18}$ alkyl, straight-chain or branched, and the radicals $R^{2''}$, $R^{3''}$, and $R^{4''}$ are each independently selected from the group consisting of $C_1$ to $C_8$ alkyl, straight-chain or branched.

9. The process according to claim 6, wherein the organic nitrate salt is selected from the group consisting of tetra-n-butylammonium nitrate, methyltri-n-octylammonium nitrate, tetra-n-butylphosphonium nitrate, methyltri-n-octylphosphonium nitrate and 1-butyl-3-methylimidazolium nitrate.

10. The process according to claim 1, wherein the unsubstituted or at least monosubstituted, monounsaturated or polyunsaturated cycloalkene or the at least one organic nitrate salt is initially charged and combined with the reaction medium, and the other of these two components in each case is subsequently added.

11. The process according to claim 1, wherein the unsubstituted or at least monosubstituted, monounsaturated or polyunsaturated cycloalkene or the at least one organic nitrate salt is initially charged and combined with the reaction medium, and partially or completely dissolved in the reaction medium or mixed therewith, and the other of these two components in each case is subsequently added.

12. The process according to claim 1, wherein the unsubstituted or at least monosubstituted, monounsaturated or polyunsaturated cycloalkene and the at least one organic nitrate salt are initially charged and subsequently combined with the reaction medium.

13. The process according to claim 1, wherein the unsubstituted or at least monosubstituted, monounsaturated or polyunsaturated cycloalkene and the at least one organic nitrate salt are added to the reaction medium, and at least partially or completely dissolved in the reaction medium or mixed therewith, simultaneously or consecutively.

14. The process according to claim 1, wherein the reaction medium is a polar aprotic reaction medium which may be present in anhydrous form, in dried form or in combination with water.

15. The process according to claim 1, wherein the reaction medium is a polar aprotic reaction medium, optionally in combination with water, wherein the polar aprotic reaction medium is selected from the group consisting of aliphatic nitriles, aliphatic ketones, cycloaliphatic ketones, dialkyl carbonates, cyclic carbonates, lactones, aliphatic nitroalkanes, dimethyl sulfoxide, and esters, ethers, and mixtures of at least two of these components.

16. The process according to claim 14, wherein the reaction medium present is a polar aprotic reaction medium selected from the group consisting of acetonitrile, isobutyronitrile, adiponitrile, acetone, dimethyl carbonate, methyl ethyl ketone, 3-pentanone, cyclohexanone, nitromethane, nitropropane, tert-butyl methyl ether, dimethyl sulfoxide, gamma-butyrolactone, epsilon-caprolactone, and mixtures of at least two of these components, in each case optionally in combination with water.

17. The process according to claim 16, wherein the reaction medium is selected from the group consisting of acetonitrile, isobutyronitrile, adiponitrile, dimethyl carbonate, acetone, and mixtures of at least two of these components, optionally in combination with water.

18. The process according to claim 16, wherein the reaction medium is acetonitrile, isobutyronitrile or adiponitrile in dried or anhydrous form.

19. The process according to claim 1, wherein the reaction medium comprises one or more solubilizing components.

20. The process according to claim 19, wherein the solubilizing components present are primary alcohols, secondary alcohols, monoketones, dialkyl carbonates, or mixtures of at least two of these components, optionally in combination with water.

21. The process according to claim 19, wherein aliphatic $C_{1-6}$ alcohols are present as one or more solubilizing components, optionally in combination with water.

22. The process according to claim 1, wherein the reaction medium present is dimethyl carbonate, optionally in combination with at least one $C_{1-6}$ alcohol.

23. The process according to claim 22, wherein the reaction medium comprises water.

24. The process according to claim 19, wherein one or more solubilizing components are present in an amount of <50% by volume based on a total amount of reaction medium.

25. The process according to claim 1, wherein the organic nitrate salt is employed in an amount of 0.1 to 2.0 equivalents, based on an amount of employed unsubstituted or at least monosubstituted, monounsaturated or polyunsaturated cycloalkene.

26. The process according to claim 1, wherein a gas atmosphere comprising oxygen is advantageously provided in spatial connection with the reaction medium.

27. The process according to claim 26, wherein an oxygen-containing gas atmosphere that is in spatial communication with the reaction medium is provided, wherein a proportion of oxygen in the gas atmosphere is 10% to 100% by volume.

28. The process according to claim 26, wherein the gas atmosphere is air.

29. The process according to claim 26, wherein gas exchange between the gas atmosphere and the reaction medium is forced by introducing gas atmosphere into the reaction medium or by stirring the liquid phase in the presence of the gas atmosphere.

30. The process according to claim 29, wherein the stirring is used to control the electrochemical oxidation.

31. The process according to claim 1, wherein an amount of oxygen dissolved in the reaction medium is at least 1 mmol/L of reaction medium.

32. The process according to claim 1, wherein said process is performed in an undivided cell.

33. The process according to claim 32, wherein the undivided electrolysis cell comprises a glassy carbon anode, a graphite anode or a BDD anode.

34. The process according to claim 32, wherein the undivided electrolysis cell has a glassy carbon cathode, a graphite cathode or a BDD cathode.

35. The process according to claim 32, wherein a distance between the electrodes in the electrolysis cell is 0.1 mm to 2.0 cm.

36. The process according to claim 1, wherein a charge quantity is at least 190 C (2 F) to 970 C (10 F), for 1 mmol of unsubstituted or at least monosubstituted, monounsaturated or polyunsaturated cycloalkene.

37. The process according to claim 1, wherein the electrochemical oxidation is carried out at constant current.

38. The process according to claim 1, wherein a current density is at least 5 $mA/cm^2$, wherein a reported surface area refers to a geometric area of electrodes of the electrolysis cell.

39. The process according to claim 1, wherein a current density is at least 20 $mA/cm^2$ to 50 $mA/cm^2$, wherein a reported surface area refers to a geometric area of electrodes of the electrolysis cell.

40. The process according to claim 1, wherein an electric current used for the electrochemical oxidation derives from a renewable source.

41. The process according to claim 1, wherein the electrochemical oxidation is carried out at a temperature in a range from 0° C. to 60° C.

42. The process according to claim 1, wherein said process is performed under atmospheric pressure.

43. The process according to claim 1, wherein said process is performed under reduced pressure.

44. The process according to claim 1, wherein said process is performed under elevated pressure.

45. The process according to claim 1, wherein said process is performed batchwise.

46. The process according to claim 1, wherein said process is performed continuously.

47. The process according to claim 1, wherein said process is performed without addition of a catalyst.

48. The process according to claim 1, wherein, with the exception of oxygen or atmospheric oxygen, no further oxidants are added.

* * * * *